US010156034B1

(12) United States Patent
Hancock

(10) Patent No.: US 10,156,034 B1
(45) Date of Patent: Dec. 18, 2018

(54) HIGH VELOCITY BOBBIN SEWING SYSTEM

(71) Applicant: Templeton Colum Dean Hancock, Rawai (TH)

(72) Inventor: Templeton Colum Dean Hancock, Rawai (TH)

( * ) Notice: Subject to any disclaimer, the term of this patent is extended or adjusted under 35 U.S.C. 154(b) by 0 days.

(21) Appl. No.: 15/888,011

(22) Filed: Feb. 3, 2018

(51) Int. Cl.
*D05B 57/14* (2006.01)
*D05B 1/12* (2006.01)

(52) U.S. Cl.
CPC ..... *D05B 57/143* (2013.01); *D05B 1/12* (2013.01)

(58) Field of Classification Search
CPC ..... D05B 1/08; D05B 57/22; D05B 57/143; D05B 1/12
See application file for complete search history.

(56) References Cited

U.S. PATENT DOCUMENTS 3,509,840 A * 5/1970 Rovin ..... B65H 65/00 112/181
4,289,085 A * 9/1981 Rovin ..... B65H 51/16 112/181
9,200,396 B2 * 12/2015 McCue ..... D05C 3/00

* cited by examiner

*Primary Examiner* — Danny Worrell
(74) *Attorney, Agent, or Firm* — Michael D. Eisenberg

(57) ABSTRACT

A thread feeding system for any machine that requires a locking stitch is provided. The lower thread of the lock stitch is delivered from the inside of a rotary hook system or oscillating system of a lock stitch sewing machine. The rotary hook or oscillating hook is held in place by a bearing which is then attached to the chassis of the sewing machine. The rotary hook or oscillating hook is allowed to be driven by teeth on the inner bearing, and they may be located inside or outside, fore or aft to the positioning of the outer bearing. This allows for the void now left inside the rotary hook or oscillating hook where a pipe or tube is placed to feed the lower locking stitch thread.

15 Claims, 6 Drawing Sheets

HIGH VELOCITY BOBBIN SEWING SYSTEM

TECHNICAL FIELD

The present invention relates to sewing machines, and in particular, sewing machines that lack a bobbin.

BACKGROUND OF THE INVENTION

The maximum amount of thread that can be stored on the bobbin for a lock stitch sewing machine, be it used for sewing or embroidery, is extremely limited due to its geometric conditions. The amount of thread that can be stored within the lower bobbin covers only a fraction of what is available to the upper needle. Therefore, the lower bobbin is in constant need of refilling. The present invention addresses this problem.

BRIEF SUMMARY OF EMBODIMENTS OF THE INVENTION

A bobbinless sewing machine, comprises: a chassis; an inner bearing; a hook configured to rotate or oscillate, formed as part of the inner bearing; an outer bearing, having front and back ends, attached to the chassis and attached to the inner bearing; and a void leading to the hook. A drive mechanism is connected either to the front end or back of the outer bearing.

In a variant, the sewing machine has a stationary thread feed tube disposed in the void, configured as a conduit for thread leading to the hook and configured to remain stationary while the hook rotates or oscillates.

In another variant, the drive mechanism is driven by teeth located inside or outside or fore or aft of the inner bearing.

In a further variant, an exit end of the thread feed tube is open and the thread extends into a thread tension case.

In still another variant of the sewing machine, wherein the inner bearing has a shaped portion to provide a cavity for the reception of a thread tension case holder In yet a further variant, the sewing machine comprises a thread tension case holder having a circumferentially extending rib, having an interrupted region to allow it to be inserted into the inner bearing.

In a variant, the sewing machine has a recessed raceway that conforms to the rib. The raceway extends through a circumference of a wall of the inner bearing. The raceway is formed in a wall of the inner bearing and is closed at an outer side via a gib retainer. The gib retainer has an inwardly extending flange which forms an outer wall of the raceway.

In another variant, a peripheral surface of the rib cooperates with an inwardly facing surface of the raceway formed in the inner bearing.

In a further variant, the sewing machine has a brace having a mandrel centrally placed therein for receiving a thread tension case.

In yet another variant, the brace has a cutout for receiving the thread feed tube.

In still a further variant, the thread feed tube extends no further than a locking point of the mandrel.

In a variant, the thread feed tube has a flat recess cut out on an outer side of a rear of the thread feed tube so that it can be clamped in place to enable thread exiting the thread feed tube to exit at a proper angle.

In another variant the thread feed tube has a cut out at one end to create a channel to guide thread and allow the thread to slip smoothly into a thread tension case at a required angle.

In a further variant, the inner bearing has an inwardly extending flange on an inner wall of the raceway, the flange extending from a point adjacent to a beak of the hook to a point adjacent a forward end of an insert. The closed outer side of the raceway extends from a rearward end of the insert and from a thread catchment point of the gib.

In yet another variant, the sewing machine has a thread guard, having a rearward end positioned adjacent the beak of the hook, and having an outwardly projecting portion comprising a thread catchment point. A void is formed between a notch and the main hook body beak, the void providing for the passage of a downward passing needle. A forward end of the thread guard extends to a position adjacent the hook beak.

By changing the operation of the main hook body from rotating or oscillating off of a shaft, to being operated via a bearing. The outer bearing is secured to the chassis of the lock stitch machine. The inner bearing is integrated as part of the main hook body. By way of this arrangement, this now allows for the creation of a void on the inside of the main hook body. Within this void it is now possible for the lower thread to pass through the void by means of a tube to the feed the thread directly to a tension case, ready to form the lower locking stitch.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
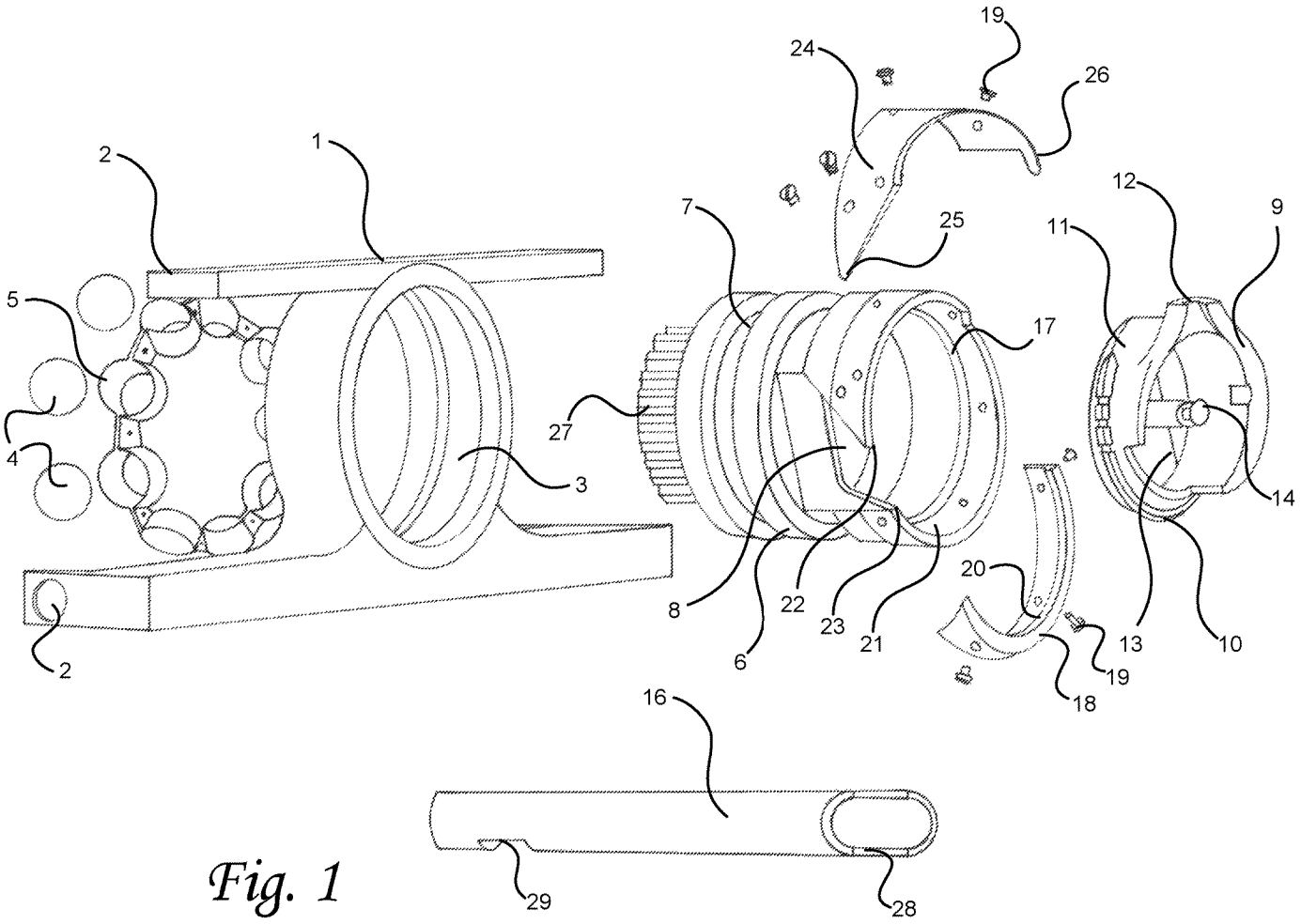
FIG. 1 is an exploded view of the bobbinless sewing machine.
Figure 2:
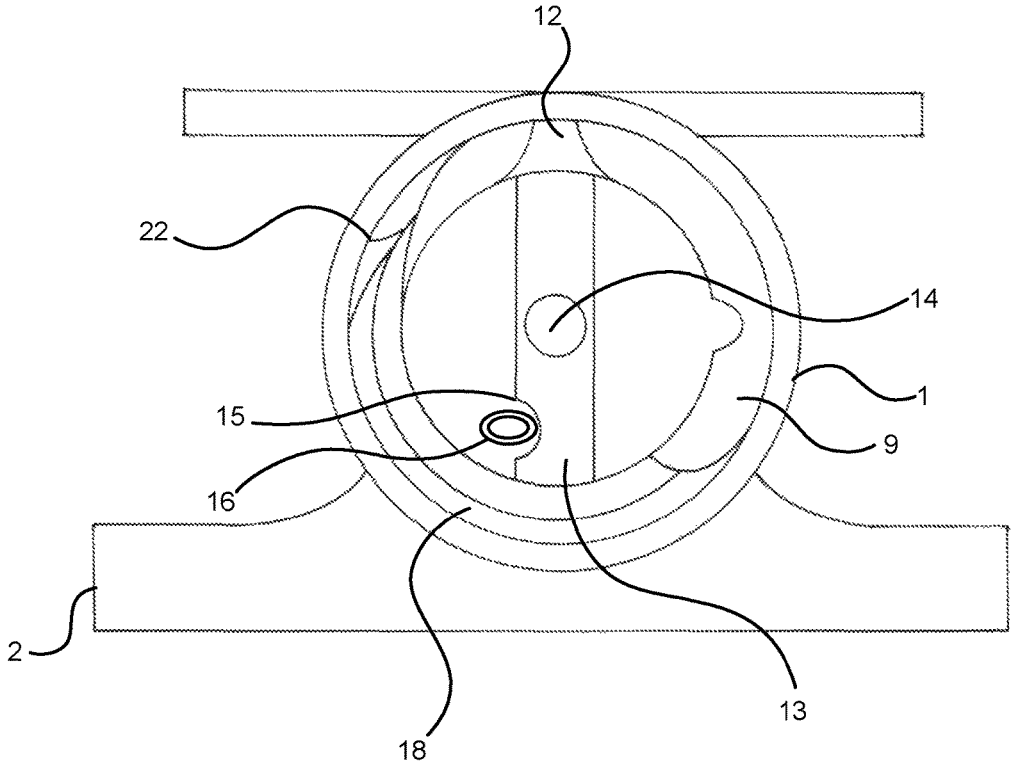
FIG. 2 is a front view of the bobbinless sewing machine.
Figure 3:
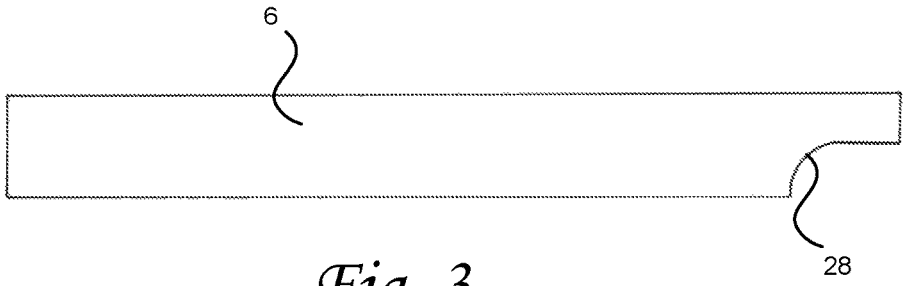
FIG. 3 is a side view of the thread feed tube.
Figure 4:
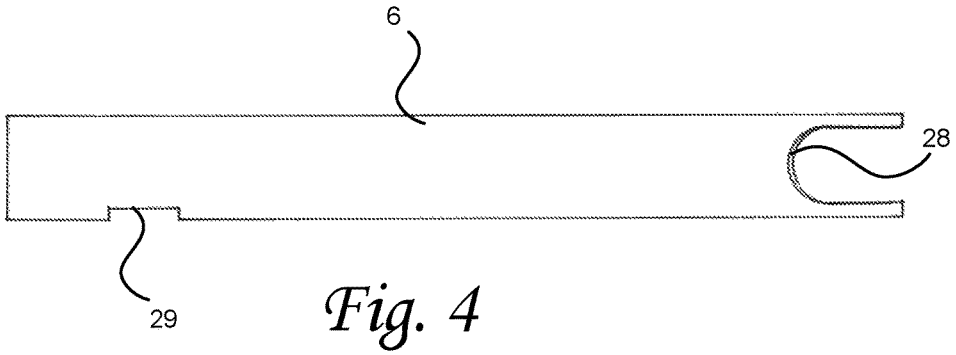
FIG. 4 is a top view of the thread feed tube.
Figure 5:
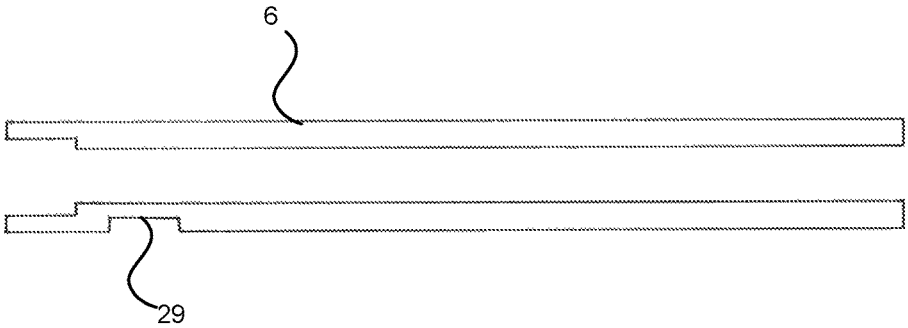
FIG. 5 is a sectional view of the thread feed tube.
Figure 6:
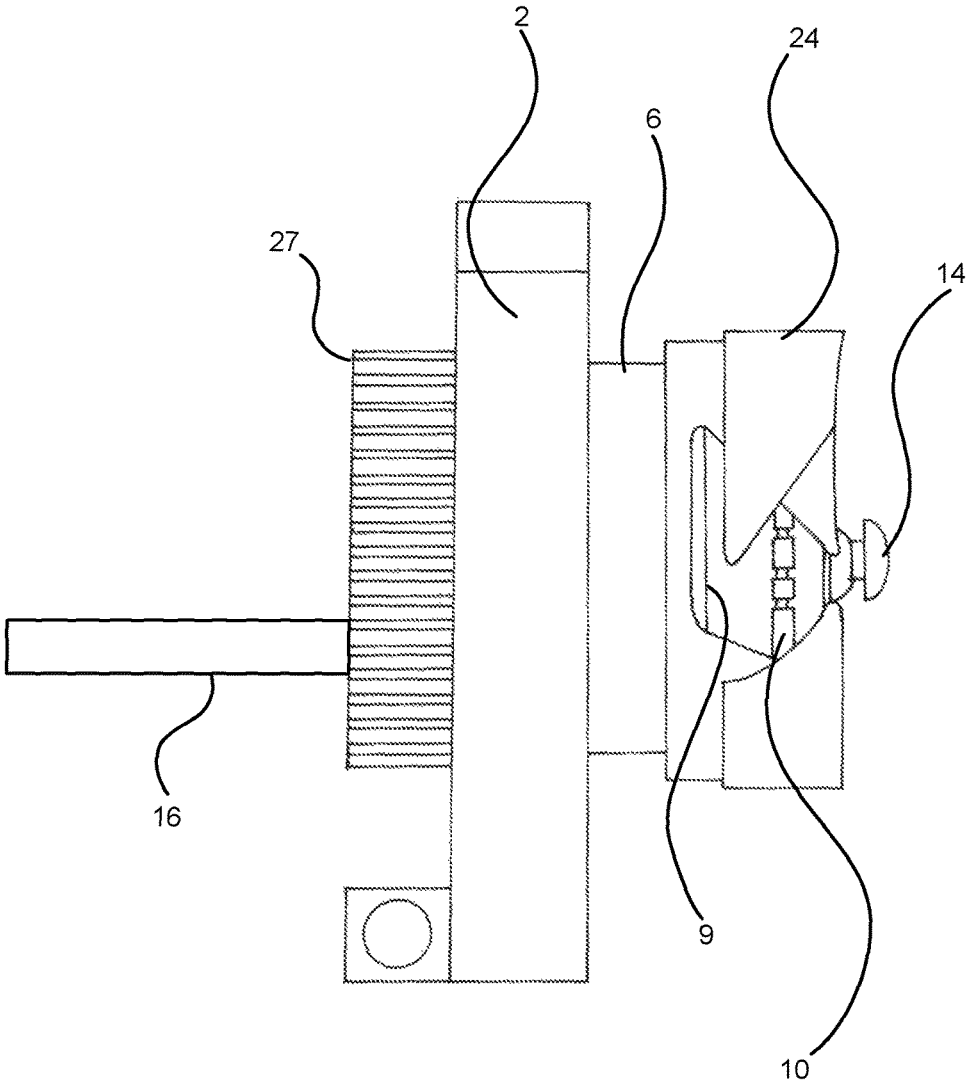
FIG. 6 is a side view of the bobbinless sewing machine.
Figure 7:
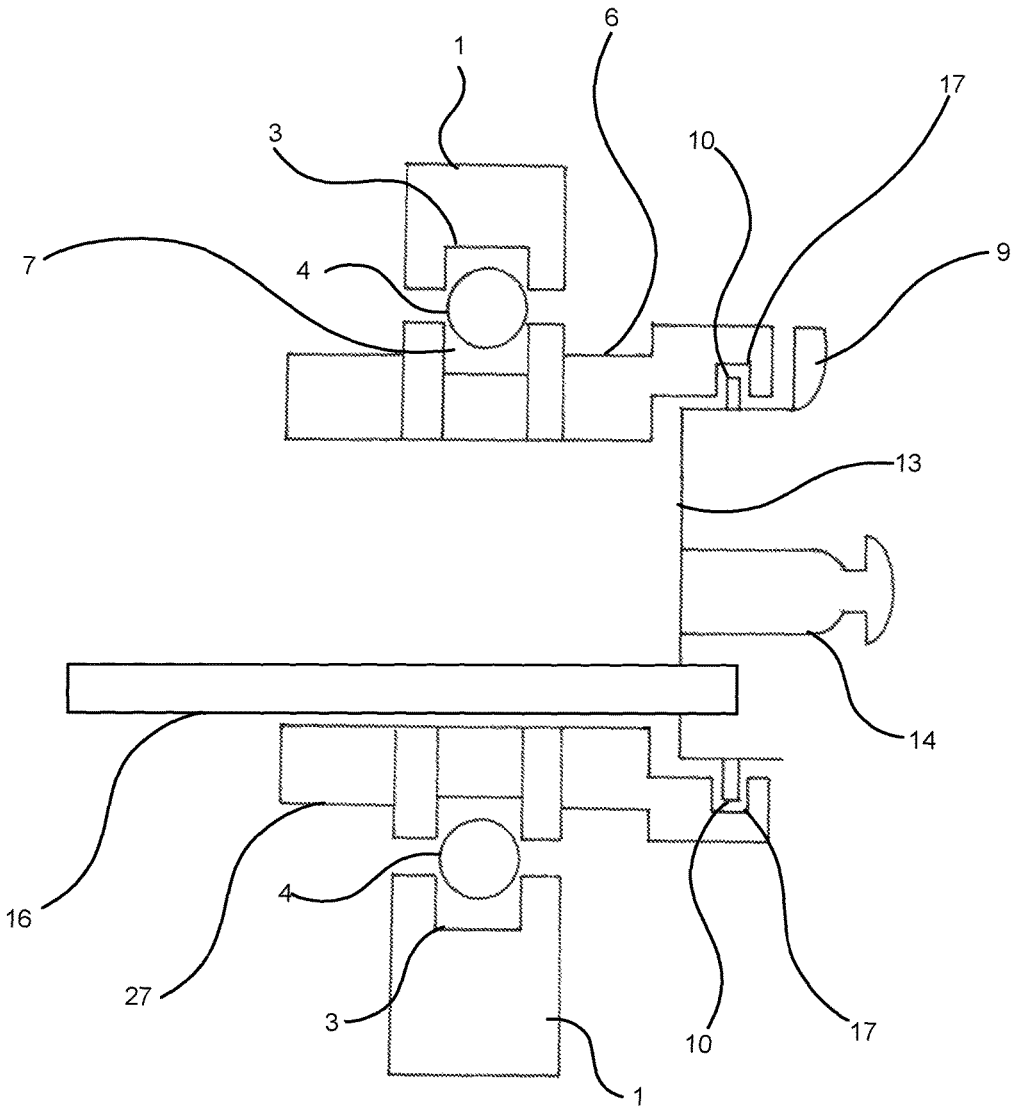
FIG. 7 is a side cross sectional view of the bobbinless sewing machine.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

The following reference numerals are used throughout this document:

1 Outer Bearing
2 Bracing Point
3 Outer Bearing Recess
4 Ball Bearings
5 Ball Cage
6 Inner Bearing Hook Main Body
7 Inner Bearing Hook Main Body Hub
8 Inner Bearing Hook Body Cutout
9 Thread Tension Case Holder
10 Thread Tension Case Holder Rib
11 Interruption
12 Notch
13 Vertical Brace
14 Mandrel
15 Cut Out
16 Thread Feed Tube
17 Inner Bearing Hook Body Recessed Raceway
18 Gib Retainer
19 Screws
20 Gib Retainer Flange
21 Main Hook Body Inwardly Extending Flange
22 Main Hook Body Beak
23 Insert
24 Thread Guard
25 Notch
26 Thread Catchment Point
27 Gear Teeth
28 Thread Feed Tube Cut Out
29 Flat Recess
30 Drive mechanism The present invention relates to a high velocity everlasting bobbin system for a sewing machine. Referring to FIG. 1, an outer bearing 1 has bracing points 2 for securing the outer bearing 1 to the chassis of the sewing machine. The outer bearing 1 has a recess 3 for the placement of ball bearings 4 or rollers, held in place by a riveted ball cage 5 or any other suitable means. An inner bearing has a main body 6, having a hub portion 7 by which the body may be secured to the outer bearing 1. The bearing 1 may comprise of ball bearings 4 or rollers, held in place by a riveted ball cage 5 or any other suitable means. The inner bearing main body 6 has a top that is shaped, or a shaped portion, to provide a inner bearing hook body cavity cutout 8, which is a cutout of the inner bearing hook main body for the reception of a thread tension case holder 9.

The thread tension case holder 9 has a circumferentially extending rib 10 which is interrupted 11 in a region to enable it to be inserted into the inner bearing main body 6. This interruption 11 in the rib 10 is in a region adjacent the top of the tension case holder 9. It is also adjacent to the notch 12 in its outer face which cooperates with a normal detaining finger (not shown) secured to the under surface of the machine chassis bed and below the usual stitch plate (not shown) of a sewing machine.

A detaining finger prevents rotation of the thread tension case holder by the frictional drag of the inner bearing main body 6. To the rear of the thread tension case holder 9 is located a vertical brace 13 where a mandrel 14 is centrally placed for receiving a thread tension case (not shown). Below the mandrel 14 on the vertical brace 13, is a cut out 15 for the passage of a thread feed tube 16. The rib 10 on the thread tension case holder 9 cooperates with a recessed raceway 17 which extends through the circumference of the wall of the inner bearing main hook body 6 which defines the cavity. This raceway 17 is in part cut or otherwise formed directly in the wall of the inner bearing main hook body 6 and is in part closed at its outer side by means of a gib retainer 18. The gib retainer is secured by screws 19 to the wall of the inner bearing hook main body 6. The gib retainer 18 has an inwardly extending flange 20 which forms the outer wall of the raceway in the hook body. The peripheral surface of the rib 10 cooperates with the inwardly facing surface of the hook raceway 17 formed in the inner bearing hook body 6.

The thread tension case holder 9 is held against any appreciable axil movement in relation to the inner bearing hook body 6 by the flange 20 and by, a corresponding opposed inwardly extending wall. The gib retainer 18 may be secured to the inner race bearing hook by screws 19 or rivets, or by any other suitable means. The main body 6 has an integral inwardly extending flange 21 on the inner wall of the hook raceway. This flange extends from a point adjacent to the beak 22 of the hook to a point adjacent the forward end of the insert 23. As has been explained, another portion of the hook raceway 17 is closed at its outer side by the flange 20 of the gib member 18. This closed in portion of the raceway 17 extends from the rearward end of the insert of the inner bearing main hook body 6 to the main hook body beak 22. This point also extends into a region adjacent the hook beak 22 and the forward end of the thread guard 24 when attached to the inner bearing main hook body. Secured to the circumferential face of the inner bearing hook main body 6 is a thread guard 24. This may be secured in place by screws 19 or rivets or by any other suitable means.

The thread guard 24, at its rearward end, positioned adjacent to the region of the main hook body beak 22, to its opposite end, has an outwardly projecting portion which serves to function as a thread catchment point 26. A void is formed between notch 25 and the main hook body beak 22 provided in the rearward end of the thread guard 24. The void enables the passage of the downward passing needle (not shown) into cooperation with the hook at the appropriate time in the cycle of revolution of the inner bearing hook main body 6 which partially defines the notch 25. At its forward end, the thread guard 24 extends to a position 26 opposite to the hook beak 22 and cooperates by catching the loop formed by the upper thread as the needle withdraws from the void between the hook beak 22 and the notch 25. The thread guard 24 may be secured to the inner race bearing hook 6 by screws 19 or rivets, or by any other suitable means.

The inner bearing hook body 6 is driven by a gear mechanism off the main drive shaft of the machine. The teeth for the gear 27 of the inner bearing hook 6 may be located inside or outside, fore or aft of the of the inner bearing hook main body hub 7. Within the interior void of the inner rotary hook bearing 6, it is possible to feed the lower locking stitch thread through, inside of the inner rotary hook bearing 6, and feed the thread directly into a thread tension case (not shown) via a thread feed tube 16, eliminating the need for refillable bobbins.

The thread feed tube has a cut out 28 at one end to create a channel to guide the thread and allow the thread to slip smoothly into a thread tension case (not shown) at the required angle. The cutout may be formed by cutting half of the circumference away at about ⅜ths of inch or any other appropriate/suitable measurement and removing it from the tube. The thread feed tube extends no further than the locking point of the mandrel 14 of the thread tension case holder 9. The thread feed tube 16 can be fixed in place at the cut out 15 of the vertical brace 13 which is part of the thread tension case holder 9. A flat recess 29 is cut out on the outer side of the rear of the thread feed tube 16 so that it can be clamped in place to make sure the thread exits the thread feed tube at the correct angle, and therefore preventing any movement of the thread feed tube 16. The thread feed tube 16 is disposed in the void, and is configured as a conduit for thread leading to the hook and is configured to remain stationary while the hook rotates or oscillates.

Figure 8:
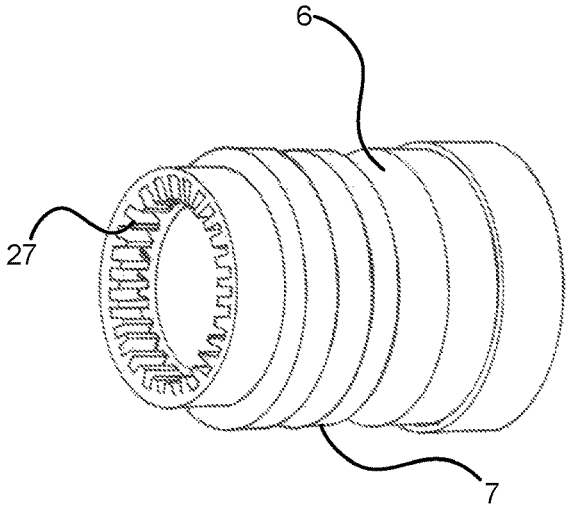
FIG. 8 is a perspective view of an inner bearing hook main body hub with teeth located on its inner surface.
Figure 9:
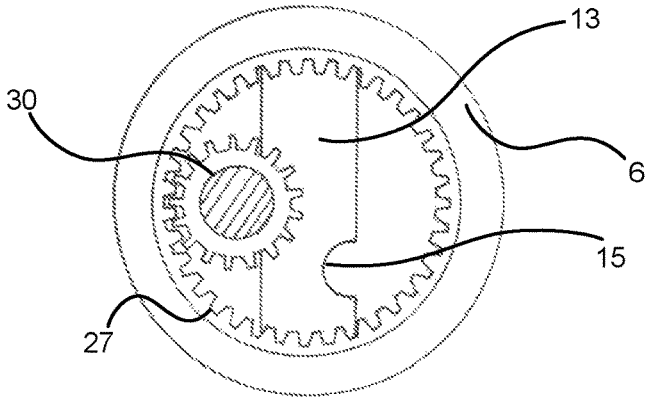
FIG. 9 is a cross section view of an inner bearing hook main body hub with teeth located on its inner surface and drive mechanism.

In a variant, referring to FIGS. 8 and 9, The inner bearing hook body 6 is driven by a drive mechanism 30 comprising a gear mechanism off the main drive shaft of the machine. The teeth for the gear 27 of the inner bearing hook 6 are located in the inside of inner bearing hook main body hub. Referring to FIG. 9, a pinion gear 30 comes off of the main shaft of a sewing machine drives the gear 27. Within the interior void of the inner rotary hook bearing 6, it is possible to feed the lower locking stitch thread through, inside of the inner rotary hook bearing 6, and feed the thread directly into a thread tension case (not shown) via a thread feed tube 16, eliminating the need for refillable bobbins.

The invention is not to be understood as limited to the details of construction and relative arrangements and proportions of parts of the preferred embodiment thereof shown and described, as modifications thereof may obviously be made by those skilled in the art within the spirit and scope of the invention.

What is claimed is:

1. A bobbin system for a sewing machine, the bobbin system comprising:

an inner bearing;

a hook configured to rotate or oscillate, formed as part of the inner bearing;

an outer bearing, attachable to a chassis of the sewing machine and attached to the inner bearing;

a rolling elements connecting the inner bearing to the outer bearing;

an interior void traversing the inner bearing, leading to the hook; and a drive mechanism, connected to the inner bearing.

2. The bobbin system of claim 1, further comprising a stationary thread feed tube disposed in the interior void, configured as a conduit for thread leading to the hook and configured to remain stationary while the hook rotates or oscillates.

3. The bobbin system of claim 1, wherein the drive mechanism is driven by teeth located inside or outside or fore or aft of the inner bearing.

4. The bobbin system of claim 2, wherein an exit end of the thread feed tube is open and the thread extends into a thread tension case.

5. The bobbin system of claim 1, wherein the inner bearing has a shaped portion to provide a cavity for the reception of a thread tension case holder.

6. The bobbin system of claim 1, further comprising a thread tension case holder having a circumferentially extending rib, having an interrupted region to allow the thread tension case holder to be inserted into the inner bearing.

7. The bobbin system of claim 6, further comprising a recessed raceway that conforms to the rib, wherein the raceway extends through a circumference of a wall of the inner bearing;

wherein the raceway is formed in a wall of the inner bearing and is closed at an outer side via a gib retainer;

wherein the gib retainer has an inwardly extending flange which forms an outer wall of the raceway.

8. The bobbin system of claim 7, wherein a peripheral surface of the rib cooperates with an inwardly facing surface of the raceway formed in the inner bearing.

9. The bobbin system of claim 1, further comprising a brace having a mandrel centrally placed therein for receiving a thread tension case, the mandrel having a locking point.

10. The bobbin system of claim 9, wherein the brace has a cut out for receiving the thread feed tube.

11. The bobbin system claim 9, wherein the thread feed tube extends no further than the locking point of the mandrel.

12. The bobbin system of claim 11, wherein the thread feed tube has a flat recess cut out on a outer side of a rear of the thread feed tube so that it can be clamped in place.

13. The bobbin system of claim 2, wherein the thread feed tube has a cut out at one end to create a channel to guide thread and allow the thread to slip smoothly into a thread tension case.

14. The bobbin system of claim 8, wherein inner bearing has an inwardly extending flange on an inner wall of the raceway, the flange extending from a point adjacent to a beak of the hook to a point adjacent a forward end of an insert;

wherein the closed outer side of the raceway extends from a rearward end of the insert and from a thread catchment point of the gib.

15. The bobbin system of claim 14, further comprising a thread guard, having a rearward end positioned adjacent the beak of the hook, and having an outwardly projecting portion comprising a thread catchment point;

wherein a void is formed between a notch and the beak of the hook, the void providing for the passage of a downward passing needle;

wherein a forward end of the thread guard extends to a position adjacent the hook beak.

* * * * *